US006543945B2

(12) United States Patent
Nakashima et al.

(10) Patent No.: US 6,543,945 B2
(45) Date of Patent: Apr. 8, 2003

(54) INK FILM WITH CORES HAVING DIFFERENT DIAMETER SHAFT SECTIONS

(75) Inventors: Masahiro Nakashima, Fukuoka (JP); Takaharu Kobayashi, Fukuoka (JP); Takashi Watanabe, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/823,065

(22) Filed: Mar. 30, 2001

(65) Prior Publication Data

US 2001/0042454 A1 Nov. 22, 2001

(51) Int. Cl.[7] ..... B41J 17/32; B41J 33/22; B41J 33/16

(52) U.S. Cl. ..... 400/208.1; 400/208

(58) Field of Search ..... 400/208, 208.1, 400/207; 347/214

(56) References Cited

U.S. PATENT DOCUMENTS 4,924,242 A * 5/1990 Fukawa ..... 347/214
5,492,422 A * 2/1996 Kondo ..... 242/343.2
5,562,352 A * 10/1996 Whritenor et al. ..... 400/208

FOREIGN PATENT DOCUMENTS

JP 3-33477 7/1991
JP 08058199 A * 3/1996 ..... B41J/17/32
JP 10016341 A * 1/1998 ..... B41J/17/24

OTHER PUBLICATIONS

Kuroda et al., machine translation of JP 8–58199, from Japanese Patent Office website.*

* cited by examiner

*Primary Examiner*—Daniel J. Colilla
(74) *Attorney, Agent, or Firm*—RatnerPrestia

(57) ABSTRACT

A user does not have to observe the orientation of a supply-side film core and a roll-up-side film core, when placing them into a case. Shaft sections are disposed at both ends of the supply-side film core and the roll-up-side film core made of resins. The shaft sections have different diameters from each other. Each shaft section has a diameter corresponding to each supporting section. The user can therefore set the ink film in a predetermined position and orientation in the case as a single step.

10 Claims, 7 Drawing Sheets

INK FILM WITH CORES HAVING DIFFERENT DIAMETER SHAFT SECTIONS

FIELD OF THE INVENTION

The present invention relates to a contrast agent film rolling device used in a printer.

BACKGROUND OF THE INVENTION

A thermal transfer system using ink film for printing has been widely used in a printer. The thermal transfer system comprises a thermal head as a printing means, a supply-side-film core supplying an rolled ink film in accordance with the supply of paper, and a film core rolling up the ink film after printing. The cores are disposed ahead and behind the thermal head.

FIG. 7(*a*) is a perspective view of the printer having the ink film, FIG. 7(*b*) is an perspective view of an exploded ink film cassette. As shown in FIG. 7(*a*), the printer includes case 1 and removable ink film cassette 2. As shown in FIG. 7(*b*), ink film cassette 3 includes cassette housing 3, supply-side film core 4 and roll-up-side film core 5 which are rotatable and removable in cassette housing 3, and ink film 6 rolled up and held with a tension by supply-side film core 4 and roll-up side film core 5.

More specifically, supply-side film core 4 and roll-up-side film core 5 are typically paper tubes made of corrugated paper. One end of virgin ink film 6 is attached to supply-side film core 4, and the other end is attached to roll-up-side film core 5. The paper tube of supply-side film core 4 is usually the same size as that of roll-up-side film core 5. Gear flange 7, which is used for roll-up-driving the cores in the device, is inserted into both ends of each core, and gap 8 is formed in both ends of each core to carry rotation.

When ink film 6 has been used up, a new ink film 6 may be inserted along with new supply-side film core 4 and roll-up-side film core 5. Then, gear flanges 7 are inserted with proper orientation into the paper tubes of film cores 4 and 5. Ink film 6 (along with cores 4 and 5) is placed in cassette housing 3.

It is possible for cassette housing 3 to be replaced in case 1 as a single step. The roll-up side and the supply side film cores must be set in a predetermined position and orientation, and the ink-coated side of ink film 6 must face correctly. Consequently, the user need only place cassette housing 3 in the correct orientation in case 1. A conventional device may comprise contacting piece 9. Contacting piece 9 helps the user to notice whether cassette housing 3 is properly positioned and oriented within case 1.

On the other hand, in another conventional device, for cost reduction, cassette housing 3 is omitted, and only cores 4 and 5 are placed in the device. This device has no feature to prevent cores 4 and 5 from being placed incorrectly. A similar structure to cassette housing 3 can be formed in four gear flanges 7 inserted into cores 4 and 5, and the structure can place cores 4 and 5 only in a predetermined position and orientation in the device. However, there is still a problem that the paper tubes must be placed in the device after checking each core's position.

Furthermore, regardless of the presence or absence of cassette housing 3 holding film cores 4 and 5, whenever the user places the ink film in case 1, the conventional thermal transfer printer requires the user to make burdensome operations such as observing the orientation of the gear flange placed at paper tubes of cores 4 and 5, and further the orientation of the ink film placed in case 1.

SUMMARY OF THE INVENTION

In a printer employing a contrast agent (i.e. ink) film, shaft sections at both ends of a supply-side film core and a roll-up-side film core, have different diameters. Gears are disposed at one end of the supply-side film core and one end of the roll-up-side film core. Supporting sections correspond to the diameters of each shaft section.

In an alternative exemplary embodiment, a holding section is provided for rotatably holding the shaft section of one end of the roll-up-side core, a supporting section for rotatably holding the shaft section in the other end of the roll-up-side film core, and another supporting section for rotatably holding the shaft sections of both ends of the supply-side film core.

DESCRIPTION OF THE PREFERRED EMBODIMENT

Embodiments of the present invention will be described with referring to drawings hereinafter.

(Embodiment 1)

Figure 1A:
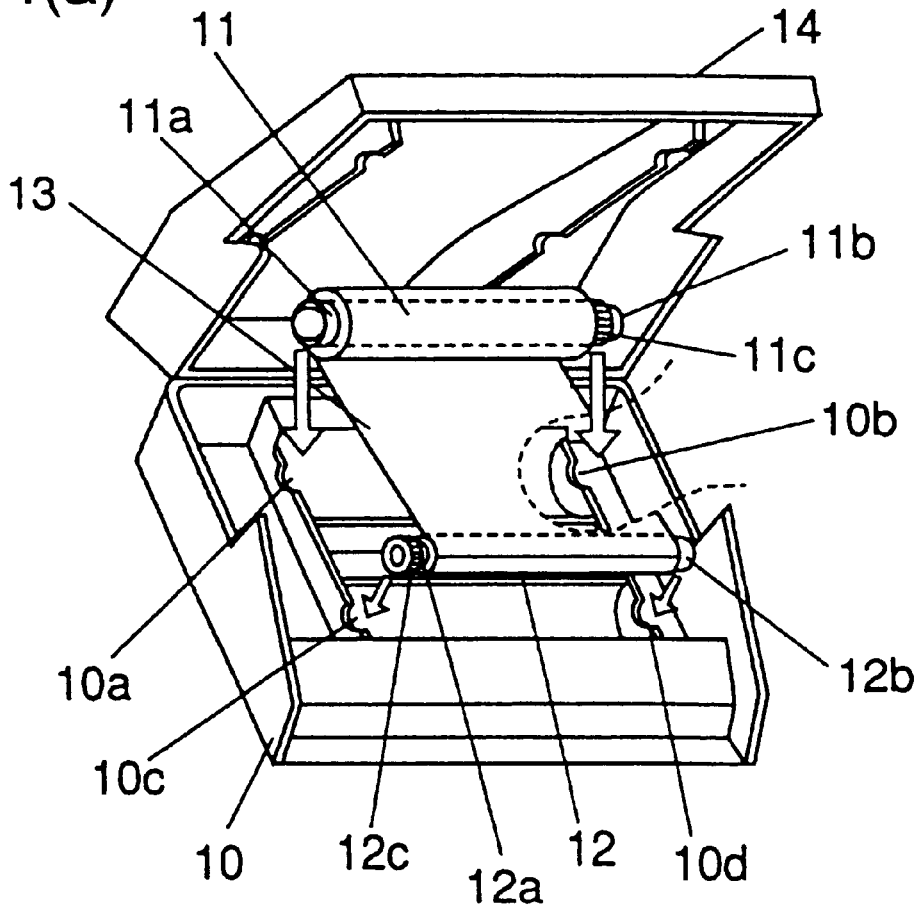
FIG. 1(*a*) is a perspective view of a printer in accordance with a first exemplary embodiment of the present invention, and FIG. 1(*b*) is a perspective view of a roll of a contrast agent (i.e. ink) film and a core section used in a printer in accordance with the first exemplary embodiment.
Figure 1B:
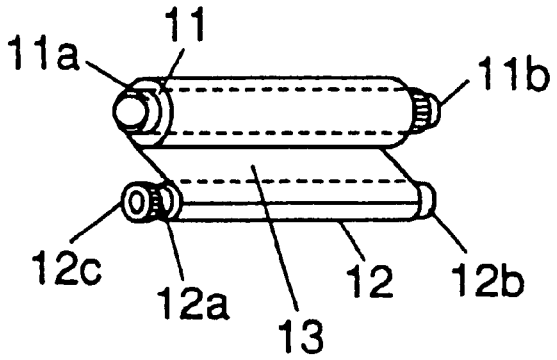
Figure 2:
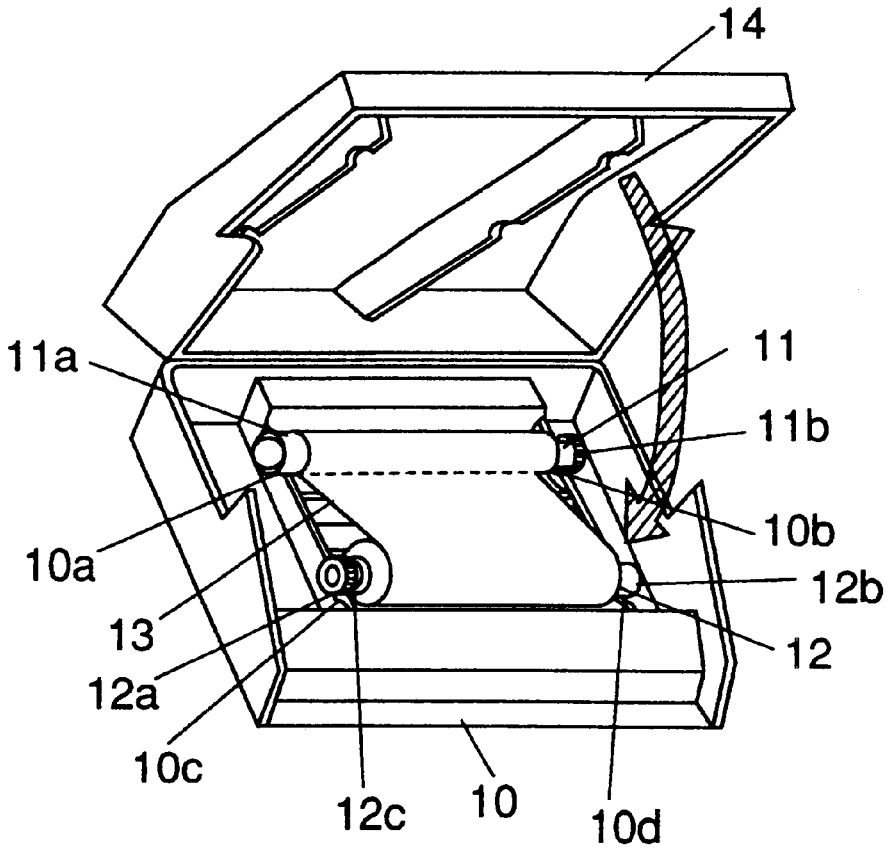
FIG. 2 is a perspective view of a printer with the ink film placed therein.

FIG. 1(*a*) is a perspective view of a printer in a first exemplary embodiment of the present invention. FIG. 1(*b*) is a perspective view of a roll of contrast agent (i.e. ink) film and a core therein. FIG. 2 is a perspective view of the printer with the ink film. The printer includes supply-side film core 11 and roll-up-side film core 12 both detachably mounted in case 10.

Unused ink film 13 is wound around supply-side film core 11, used ink film 13 for printing is rolled up around roll-up-side film core 12. Ink film 13 is tensioned between cores 11 and 12. Roll-up-side film core 12 rotates and tensions ink film 13 to roll it up while printing. Unused ink film 13 pulled out of supply-side film core 11 is rolled up by roll-up-side film core 12.

Supply-side film core 11 and roll-up-side film core 12 will be described in more detail hereafter.

Cores 11 and 12 are tubes made of resins. One end of ink film 13 is attached to core 11, and another end of ink film 13 is attached to core 12.

Shaft sections 11*a* and 11*b* having different diameters from each other are formed in both ends of core 11 and extend outwardly from a film-winding section. Core 11 is rotatably supported in a case with shaft sections 11*a* and 11*b* engaged into supporting sections of the case. Core 11 includes back-tension gear 11*c* tensioning film 13 to move it smoothly during rolling up between a film-winding section and shaft section 11*b*. Gear 11*c* is engaged with a brake gear of the printer to brake a rotation of core 11. Shaft section 11*b* is smaller than the film-winding section of core 11 in diameter.

Shaft sections 12*a* and 12*b*, having different diameters from each other, extend at both ends of roll-up-side film core 12. Gear 12*c* driven through case 3 is placed at the end of shaft section 12*a* so as to wind ink film 13. Core 12 is rotatably supported in case 10 while shaft sections 12*a* and 2*b* are engaged into supporting section 10*c* and 10*d*, respectively. Gear 12*c* is engaged with a roll-up-driving gear in case 10. The diameter of the film winding section of core 12 is smaller than that of each of shaft sections 12*a* and 12*b*, and a step is formed between the winding section and each shaft section.

Shaft sections 11*a*, 11*b*, 12*a*, and 12*b* have different diameters respectively. Each of supporting sections 10*a*, 10*b*, 10*c*, and 10*d* in case 10 has a shape corresponding to each shaft section. Therefore, a user can place the core only in a predetermined position and orientation marked in a part of case 10 when they insert the ink film. Consequently, the user does not have to attach a gear flange to the paper tube. Either, does not have to set the film core in the ink film cassette after attaching the gear flange to the tube.

According to the first embodiment, when supply-side film core 11 and rollup-side film core 12 are not placed in the proper orientation, for example, they are placed in the opposite orientation, shaft section 11*b* is not put into supporting section 10*c* since shaft section 11*b* is bigger than shaft 12*a* in diameter, as shown in FIG. 2. When core 11 and 12 are placed top side down, core 12 is not put into supporting section 10*c* since shaft 12 is bigger than shaft section 12*a* in diameter, as shown in FIG. 2. When the core is out of the supporting section, a user can confirm the improper placement and cannot completely close cover 14 of case 10. Also, a switch or a sensor may sense that the cover is open, make case 10 not work, and make the user notice the improper placement with an alarm sound or an indicator.

(Embodiment 2)

Figure 3:
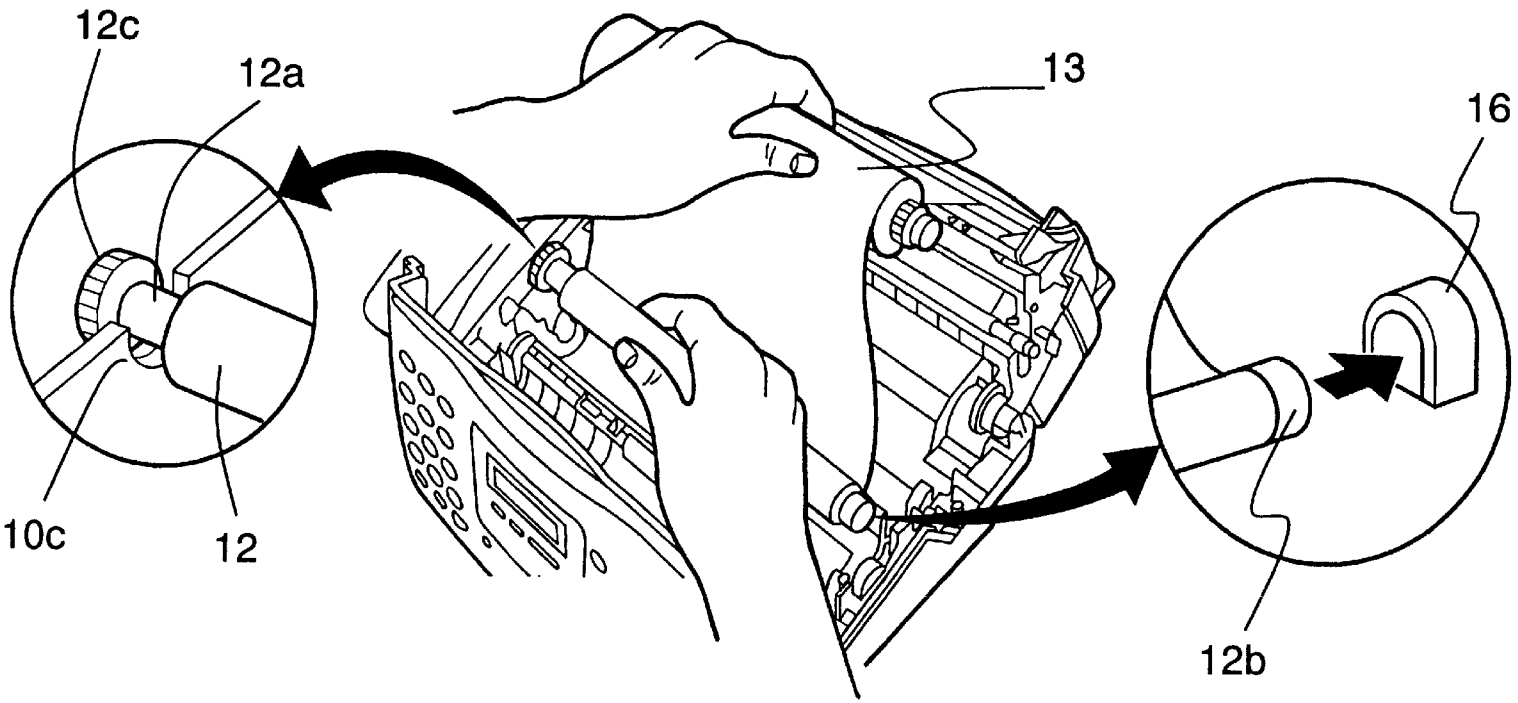
FIG. 3 is a perspective view showing how to place an ink roll device into a case.

FIG. 3 shows an ink-film-rolling device having the ink film and the core in a case of a printer according to a second exemplary embodiment of the present invention. The printer according to the second exemplary embodiment also comprises different-diameter shaft sections, and each pair of shaft sections extends at both ends of supply-side film core and roll-up-side film core. Both ends of the shaft section of the roll-up film core are smaller in diameter than the film-winding section of the core. Holding section 16 disposed in a printer case rotatably holds shaft section 12*b* at one end of roll-up-side film core 12. When an ink-film-rolling device is placed in the printer case, shaft section 12*b* of core 12 is inserted into holding section 16 first, as shown in FIG. 3. Then, shaft section 12*a* of core 12 is engaged to supporting section 10*c* of the case. Finally, shaft sections 11*a* and 11*b* in both ends of supply-side film core 11 are engaged into shaft sections 10*a* and 10*b* in the case, respectively.

Figure 4:
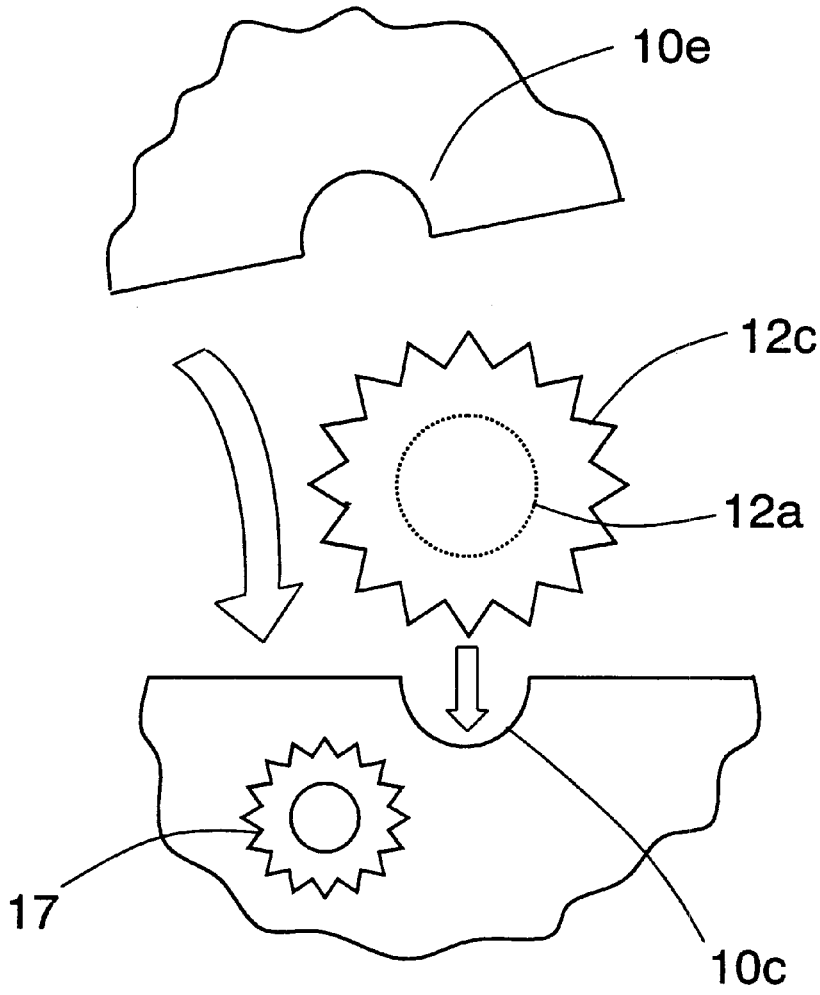
FIG. 4 is a side view showing a shaft section of the roll-up-side film core and a supporting section engaging the shaft section in the case.

FIG. 4 is a side view showing that shaft section 12*a* of roll-up-side film core 12 is engaged into supporting section 10*c* of the case. When shaft section 12*a* is engaged into supporting section 10*c* of the case, gear 12*c* engages with a roll-up-driving gear 17. Supporting section 10*e* is disposed in cover 14 of case 10. When shaft section 12*a* is properly engaged into supporting section 10*c*, cover 14 can be closed, and support section 10*e* normally holds shaft section 12*a*, and also support sections 10*c* and 10*e* holds shaft section 12*a* rotatably.

Figure 5:
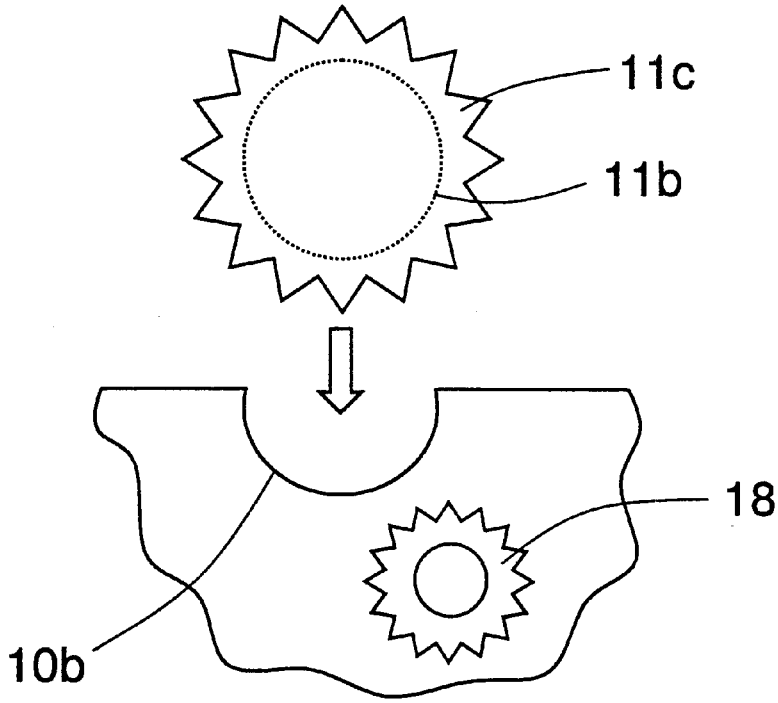
FIG. 5 is a side view showing a shaft section of a supply-side film core and a supporting section engaging the shaft section in the case.

FIG. 5 is a side view showing that shaft section 11*b* of supply-side film core 11 is engaged into supporting section 10*b* of case 10. When shaft section 11*b* is engaged to supporting section 10*b* of the case, back-tension-gear 11*c* is engaged with brake gear 18.

Figure 6:
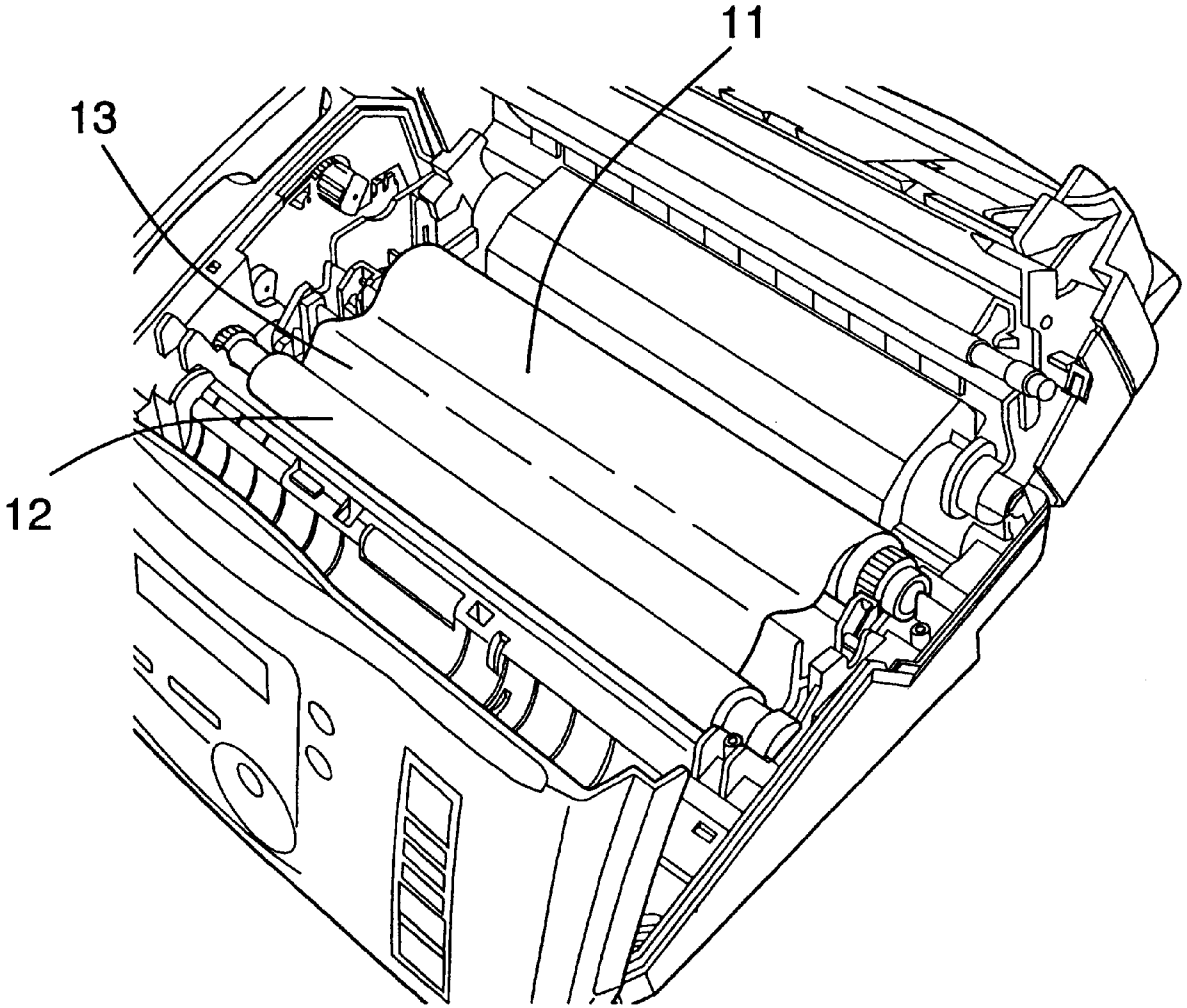
FIG. 6 is a perspective view of a printer with ink film set therein.
Figure 7A:
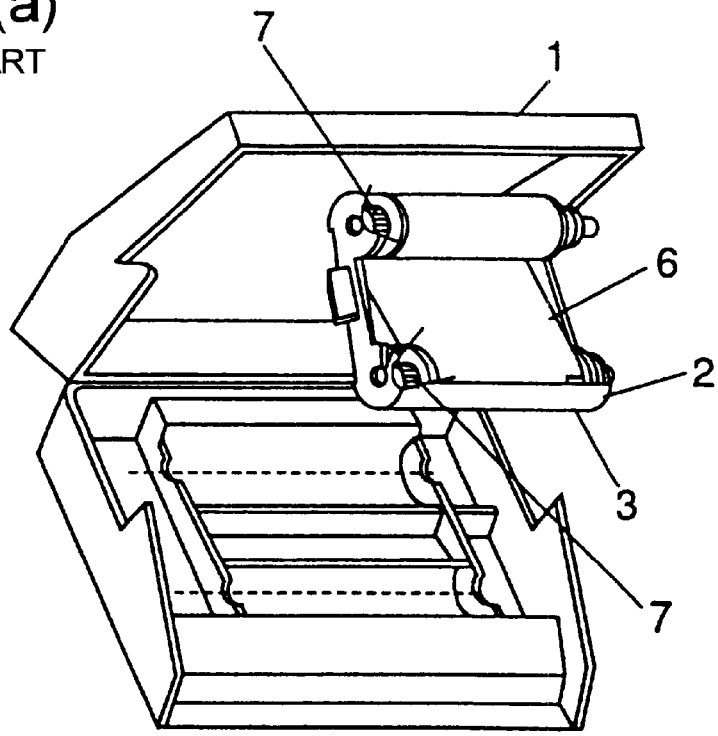
Fig. 7(a) PRIOR ART
FIG. 7(*a*) is a perspective view of a conventional printer, and FIG. 7(*b*) is an exploded perspective view of a conventional ink film cassette.
Figure 7B:
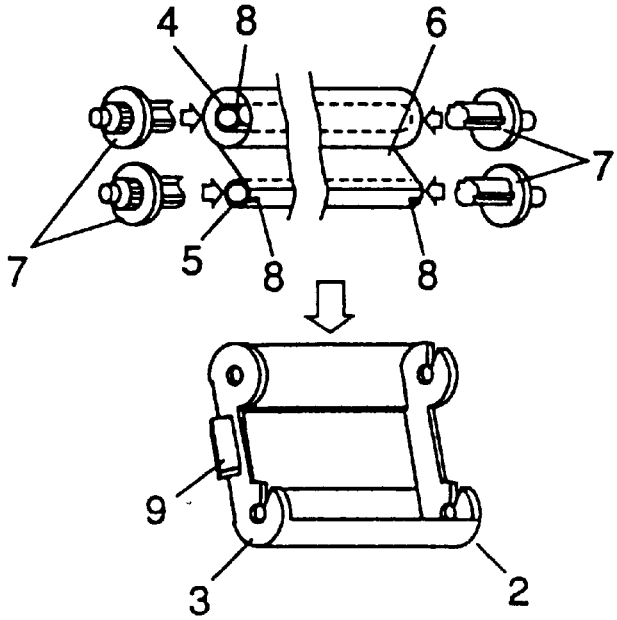
Fig. 7(b) PRIOR ART

FIG. 6 is a perspective view of the printer with the ink film set therein. Roll-up-side film core 12 rotates in the direction indicated by the arrow and tensions ink film 13, and pulls it out. Unused ink film 13 pulled out of supply-side film core 11 is used for printing and rolled up around roll-up-side film core 12.

According to the second embodiment, each of shaft sections 11*a*, 11*b*, 12*a* and 12*b* has different diameters from one another. Each of the supporting sections and holding section 16 has a shape corresponding to each shaft section. When cores 11 and 12, for example are placed in the improper orientation, the shaft sections of each film core are not put into the supporting section or the holding section of case 10, and consequently, that makes the user easily notice the improper placement.

When the supply-side film core and the roll-up-side film core are formed with tubes made of resins, forming the supporting section integral with the gear reduces a number of components. In the process of manufacturing supply-side ink film roll, when the shaft section and the gear section formed integrally makes manufacturing process of the roll difficult, the shaft section and the gear section may be separate components. If these separate components are placed into the rolls and assembled at a factory and shipped, a user does not have to place the gear flange in the core. This provides the same effect as in the case that the shaft section and the gear section are formed integrally.

What is claimed is:

1. A printer transferring a contrast agent on a contrast agent film to paper comprising:

a case;

a supply-side film core including;

a first film winding section winding the contrast agent film;

first and second shaft sections disposed at both sides of said first film winding section, respectively, said first shaft section having a different diameter than said second shaft section; and a first gear disposed at an end of the supply-side film core;

a roll-up-side film core rolling up the contrast agent film from said supply-side film core, the roll-up-side film core including;

a second film winding section about which is wound the contrast agent film;

third and fourth shaft sections disposed at both sides of said film winding section, respectively, said third shaft section having a different diameter than said fourth shaft section, said first, second, third, and fourth shaft sections having different diameters from each other; and a second gear disposed at one end of roll-up-side film core; and supporting sections disposed in said case, each of said supporting sections having different diameters corresponding to the different diameters of said first, second, third and fourth shaft sections.

2. The printer as defined in claim 1, wherein said first and second shaft sections have smaller diameters than said first film winding section, and said first shaft section has a smaller diameter than said second shaft section.

3. The printer as defined in claim 1, wherein said first shaft section has a smaller diameter than said second film winding section, and said second gear is disposed between said second film winding section and said second shaft section.

4. The printer as defined in claim 1, wherein said supply-side film core and said roll-up-side film core are made of resins.

5. A printer transferring a contrast agent on a contrast agent film to paper comprising:

a case;

a supply-side film core including;

a first film winding section winding the contrast agent film;

a first shaft section disposed at a side of said first film winding section, said first shaft section having a first diameter; and a first gear disposed at one end of said supply-side film core;

a roll-up-side film core rolling up the contrast agent film from said supply-side film core, including:

a second film winding section about which is wound the contrast agent film;

a second shaft section disposed at a first side of said second film winding section, said second shaft section having a second diameter;

a third section disposed at a side other than said first side of said second film winding section, said third shaft section having a third diameter, wherein said first, second, and third shaft sections have different diameters from each other; and a second gear disposed at said second shaft section;

a holding section disposed in said case and rotatably holding said second shaft section;

a supporting section disposed in said case and rotatably holding said third shaft section; and a further supporting section disposed in said case and rotatably holding said first shaft section, wherein said holding section, said supporting section and said further supporting section each have different diameters and said different diameters each correspond to the different diameters of said first, second, and third shaft sections.

6. The printer as defined in claim 5, wherein said supply-side film core and said roll-up-side film core are made of resins.

7. The printer as defined in claim 5 further comprising:

a roll-up-driving gear engaging with said second gear in said case; and a brake gear engaging with said first gear disposed in said case.

8. A contrast agent film-rolling device used in a printer transferring a contrast agent on a contrast agent film to paper, comprising:

a supply-side film core including;

a first film winding section winding the contrast agent film;

a first shaft section disposed at a side of said first film winding section; and a first gear disposed in one end of said supply-side film core; and a roll-up-side film core rolling up the contrast agent film from said supply-side film core, including;

a second film winding section about which is wound the contrast agent film;

second shaft sections disposed at respective sides of said second film winding section, said second shaft sections having different diameters from each other and different diameters than said first shaft section; and a second gear disposed at one end of said roll-up-side film core.

9. The contrast agent film rolling device as defined in claim 8, wherein said second shaft section has a smaller diameter than said second winding section.

10. The contrast agent film rolling device as defined in claim 8, wherein said supply-side film core and said roll-up-side film core are made of resins.

* * * * *

UNITED STATES PATENT AND TRADEMARK OFFICE

CERTIFICATE OF CORRECTION

PATENT NO. : 6,543,945 B2
DATED : April 8, 2003
INVENTOR(S) : Nakashima et al.

It is certified that error appears in the above-identified patent and that said Letters Patent is hereby corrected as shown below:

Title page,
Insert Item:
-- [30] Foreign Application Priority Data
JP 11-352948 12/13/1999 --.

Signed and Sealed this

Fourth Day of November, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,543,945 B2
DATED : April 8, 2003
INVENTOR(S) : Nakashima et al.

It is certified that error appears in the above-identified patent and that said Letters Patent is hereby corrected as shown below:

Title page,
Please delete Item "[30], Foreign Application Priority Data, JP 11-352948 12/13/1999".

Signed and Sealed this

First Day of June, 2004

JON W. DUDAS
*Acting Director of the United States Patent and Trademark Office*